US008737664B2

(12) United States Patent
Tiscareno et al.

(10) Patent No.: US 8,737,664 B2
(45) Date of Patent: May 27, 2014

(54) IN-THE-EAR PORTING STRUCTURES FOR EARBUD

(75) Inventors: Victor M. Tiscareno, Issaquah, WA (US); Kurt Stiehl, San Jose, CA (US)

(73) Assignee: Apple Inc., Cupertino, CA (US)

( * ) Notice: Subject to any disclaimer, the term of this patent is extended or adjusted under 35 U.S.C. 154(b) by 1340 days.

(21) Appl. No.: 12/214,467

(22) Filed: Jun. 18, 2008

(65) Prior Publication Data

US 2009/0316944 A1 Dec. 24, 2009

(51) Int. Cl.
*H04R 25/00* (2006.01)

(52) U.S. Cl.
USPC ..... 381/370; 381/23.1; 381/300; 381/312; 381/376

(58) Field of Classification Search
None
See application file for complete search history.

(56) References Cited

U.S. PATENT DOCUMENTS

| | | | | |
|---|---|---|---|---|
| 4,498,461 | A * | 2/1985 | Hakansson | 600/25 |
| 6,118,878 | A * | 9/2000 | Jones | 381/72 |
| 7,680,292 | B2 * | 3/2010 | Warren et al. | 381/322 |
| 7,916,888 | B2 * | 3/2011 | Sapiejewski et al. | 381/382 |
| 2006/0098833 | A1 * | 5/2006 | Juneau et al. | 381/328 |
| 2007/0183613 | A1 * | 8/2007 | Juneau et al. | 381/322 |
| 2007/0189569 | A1 * | 8/2007 | Haapapuro et al. | 381/380 |
| 2008/0031481 | A1 * | 2/2008 | Warren et al. | 381/322 |
| 2008/0299339 | A1 * | 12/2008 | Keady | 428/35.7 |
| 2008/0311324 | A1 * | 12/2008 | Keady | 428/35.7 |
| 2009/0060245 | A1 * | 3/2009 | Blanchard et al. | 381/345 |
| 2009/0116677 | A1 * | 5/2009 | Jones et al. | 381/380 |
| 2009/0316944 | A1 * | 12/2009 | Tiscareno et al. | 381/346 |
| 2010/0128905 | A1 * | 5/2010 | Warren et al. | 381/312 |
| 2010/0202645 | A1 * | 8/2010 | Puria et al. | 381/328 |
| 2011/0051981 | A1 * | 3/2011 | Lehdorfer et al. | 381/380 |
| 2011/0129108 | A1 * | 6/2011 | Miller et al. | 381/322 |

* cited by examiner

*Primary Examiner* — Marlon Fletcher
(74) *Attorney, Agent, or Firm* — Blakely, Sokoloff, Taylor & Zafman LLP

(57) ABSTRACT

Systems, apparatus and methods are discussed for controlling resonance in in-the-ear headphones. Resonance effects resulting from wave reflection and superposition can occur in the cavity formed by the port tube of an earbud and the wearer's ear canal. In this invention, acoustically resistive structures are provided to create sound diffusion in the cavity. In one embodiment, a spring coil with several adjustable parameters is inserted into the port tube. In another embodiment, a pattern of grooves is carved into the inner surface of the port tube. Porous filters can also be used in conjunction with both of the embodiments described above. The result of providing the resistive structures in an earbud is a flattened cavity frequency response and improved sound quality.

42 Claims, 7 Drawing Sheets

IN-THE-EAR PORTING STRUCTURES FOR EARBUD

BACKGROUND OF THE INVENTION

This disclosure relates to headphone acoustics design, and in particular, relates to porting structures that control resonance in in-the-ear headphones.

Headphones are commonly used with a variety of electronic devices to provide mobile and/or personal access to audio content. For example, headphones can be used with music players, such as MP3, CD, and cassette players. Headphones can also be used with cellular phones, personal digital assistants, computers, and most other types of electronic devices that produce audio signals.

There are many types of headphones in existence. Some headphones are supra-aural, meaning that they sit on top of the ear. These headphones are particularly susceptible to external noise because they do not enclose the ear. Other headphones are circum-aural. These headphones surround the ear to create a sound-isolated cavity that blocks out external noise. Circum-aural headphones can perform very well, but are bulky and inconvenient for portable applications. Still another type of headphone is worn inside the ear. These headphones, also called earphones or earbuds, can sit outside the ear canal or be inserted into the ear canal. The latter type, often called canalphones or in-the-ear earbuds, can have better acoustic performance than the former types because the earbuds form an air tight seal in the ear canal to block out external noise.

Like loudspeakers, headphones convert electrical signals into audible sound via one or more transducers. One basic type of transducer comprises a coil of wire, called a voice coil, attached to the apex of a cone or dome shaped diaphragm. The voice coil is positioned in a permanent magnetic field, created, for example, by a pair of permanent magnets. Electrical current is passed through the voice coil, turning it into an electromagnet. The force generated by the fields of the electromagnet and the permanent magnet moves the voice coil back and forth, which in turn moves the diaphragm. The movement of the diaphragm creates longitudinal pressure waves in the air, which are perceived by our ears and brain as sound. In this manner, information carrying electrical current can be converted to information carrying acoustic waves.

The sound quality produced by a headphone is highly dependent on the design of its transducer(s). However, there are other parameters in the design of headphones, and in particular, in in-the-ear earbuds, that affect sound quality as well. In general, sound waves originating from a transducer must propagate through a volume of air before reaching the listener's eardrums. During this time, the sound waves can be corrupted by a variety of factors, such as ambient noise and energy loss. One particularly important factor that degrades sound quality in in-the-ear earbuds is resonance. Because in-the-ear earbuds are inserted into the ear canal, they form an air tight cavity between the earbud and the ear canal. This cavity can act like a resonator that preferentially energizes and amplifies sound waves of certain frequencies (the resonant frequencies). When a wave at one of these resonant frequencies propagates down the earbud and ear canal, it is reflected back in such a way that the amplitudes of the incident and reflected waves are in phase and additive. This creates a standing wave and distorts the original sound wave that was produced by the transducer. The result is undesirable distortion of the audio content being played by the headphones. Thus, there is a need in the art for in-the-ear earbuds that combat the detrimental effects of resonance to sound quality.

SUMMARY OF THE INVENTION

Accordingly, systems and methods are provided for controlling resonance in in-the-ear earbuds.

Nominally, an in-the-ear earbud includes at least one or more transducers and an air chamber (sometimes called a port tube) that couples the transducers to the wearer's ear canal. Sound waves generated by the transducers propagate through the port tube and into the ear canal. The port tube is generally a hollow cylindrical chamber surrounded by a flexible bulb tip that is configured to form an air tight seal against the walls of the ear canal. Thus, the port tube and ear canal act in concert to form a sound isolating and air tight cavity within the ear.

When the port tube is hollow, sound waves propagate down the cavity with little to no sound diffusion. The result is a situation that is prone to the generation of strong resonance effects. However, by adding acoustically resistive structures to the port tube, sound diffusion is advantageously produced and resonance effects are limited.

In one embodiment, the resistive structure that is added to the port tube is a spring coil. The spring coil disrupts steady and laminar flow of air in the port tube to cause sound diffusion. The spring coil can have several adjustable parameters to enable a fine-tuning of the frequency response of the cavity. These adjustable parameters can include, for example, the tension of the spring, the number of coils, the length of the coil, and the cross-sectional shape, as well as others.

In another embodiment, the resistive structure can include a pattern of grooves carved into the inner surface of the port tube. Like the spring coil, the grooves act to disrupt air flow and cause sound diffusion. The groove pattern can be, for example, a spiral screw thread. The grooves can have a variety of shapes. For example, the grooves can be semi-circular, triangular, and trapezoidal. By changing the groove shape, groove pattern, and the depth of the indentations, the frequency response of the cavity can be controlled.

The frequency response of a cavity with strong resonance effects generally has peaks at the resonant frequencies. The effect of resistive structures on the cavity's frequency response is, in general, to flatten the peaks. A substantially flat cavity frequency response indicates the absence of frequency-dependent distortion. The embodiments described above can be particularly advantageous because, although they flatten the resonant peaks of the cavity's frequency response, they do not unnecessarily dampen the frequency response at non-resonant frequencies. The result is a flatter frequency response that minimizes the amount of unnecessary energy loss.

In some embodiments, the port tube further includes one or more porous filters erected across the cross section of the tube. These filters also act to decrease the effects of resonance in the cavity. In particular, the filters act to decrease the acoustic energy across all frequencies. In addition to their acoustic properties, the filters can also provide the additional benefit of acting as dust caps to prevent foreign objects from entering the port tube.

Persons of ordinary skill in the art will appreciate that at least some of the various embodiments described herein can be combined together, or they can be combined with other embodiments without departing from the spirit of the present invention.

BRIEF DESCRIPTION OF THE FIGURES

The above and other objects and advantages of the invention will be apparent upon consideration of the following detailed description, taken in conjunction with the accompanying drawings, in which like reference characters refer to like parts throughout, and in which.

DETAILED DESCRIPTION

To provide an overall understanding of the invention, certain illustrative embodiments will now be described. However, it will be understood by one of ordinary skill in the art that the systems, methods and apparatus described herein may be adapted and modified as is appropriate for the application being addressed and that they may be employed in other suitable applications, and that such other additions and modifications will not depart from the scope hereof.

Figure 1:
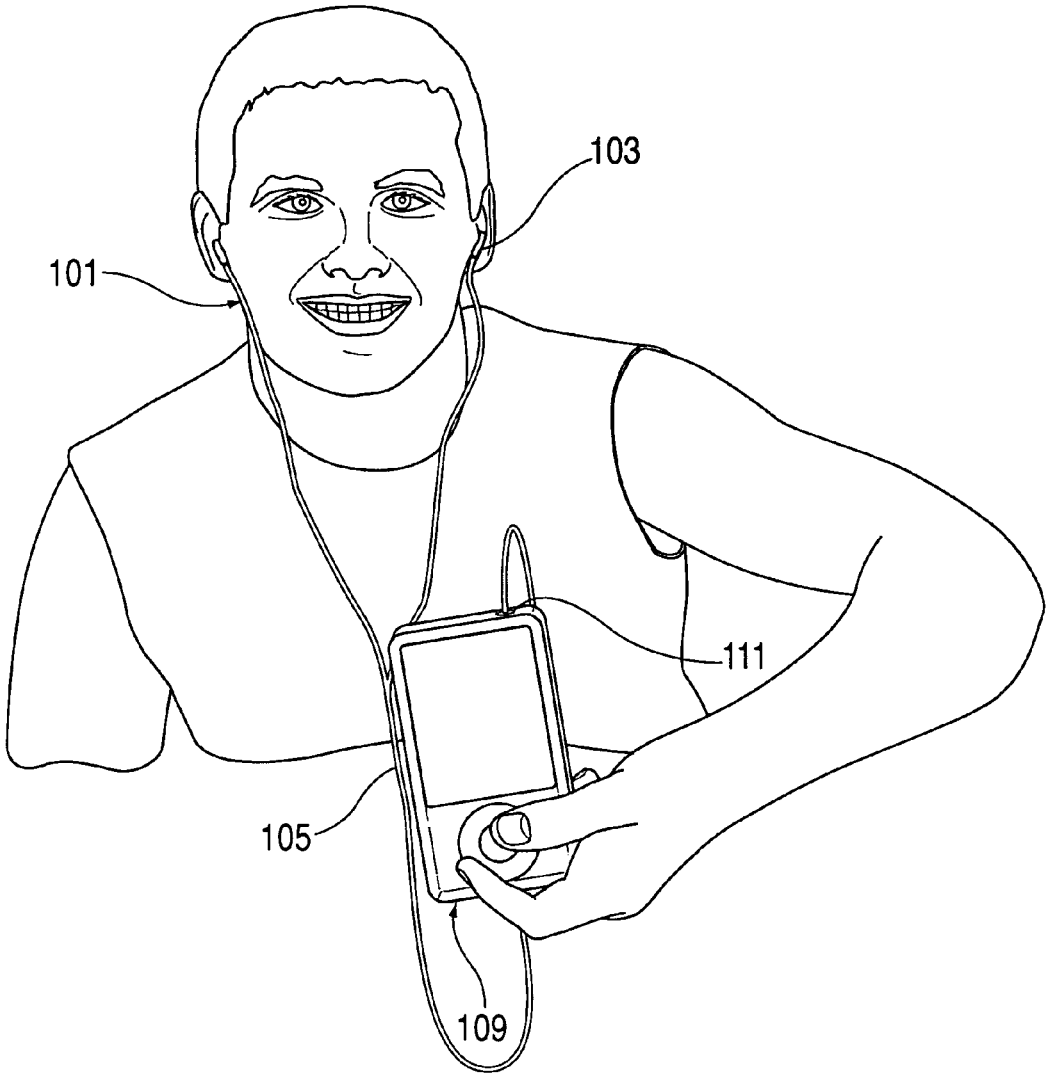
FIG. 1 is a high level illustration of a headphone system in accordance with an embodiment of the present invention.

FIG. 1 is a high level illustration of an earbud headphone system 101 in accordance with an embodiment of the present invention. Headphone system 101 can be used with any type of electronic device 109 that produces compatible audio output signals. Headphone system 101 may be connected to electronic device 109 at an audio output port 111. For illustrative purposes, electronic device 109 is shown in FIG. 1 as representing a music player. Used with a music player, headphone system 101 may preferentially include two earbuds 103, one for each ear. In an alternate embodiment, electronic device 109 can be a cellular phone. In this embodiment, headphone system 101 may only include one earbud 103, and may additionally include a microphone (not shown). In any case, each earbud 103 employed in system 101 can function in a substantially similar fashion.

Electronic device 109 can output audio content by conducting an electrical signal encoding the audio content through wire bundle 105 to earbuds 103. The audio content may be encoded in the frequency, phase, and amplitude of the electrical signals. Wire bundle 105 can comprise a group of wires that are bundled together and wrapped with insulation. Different wires in wire bundle 105 can lead to each earbud 103. The signals carried to the left and right earbuds 103 can also be different, for example to create stereophonic sound. If earbud 103 is an in-the-ear earbud, earbud 103 can be inserted into the ear canal of the wearer. The functionality of earbud 103 is elaborated below in conjunction with FIG. 2A.

Figure 2A:
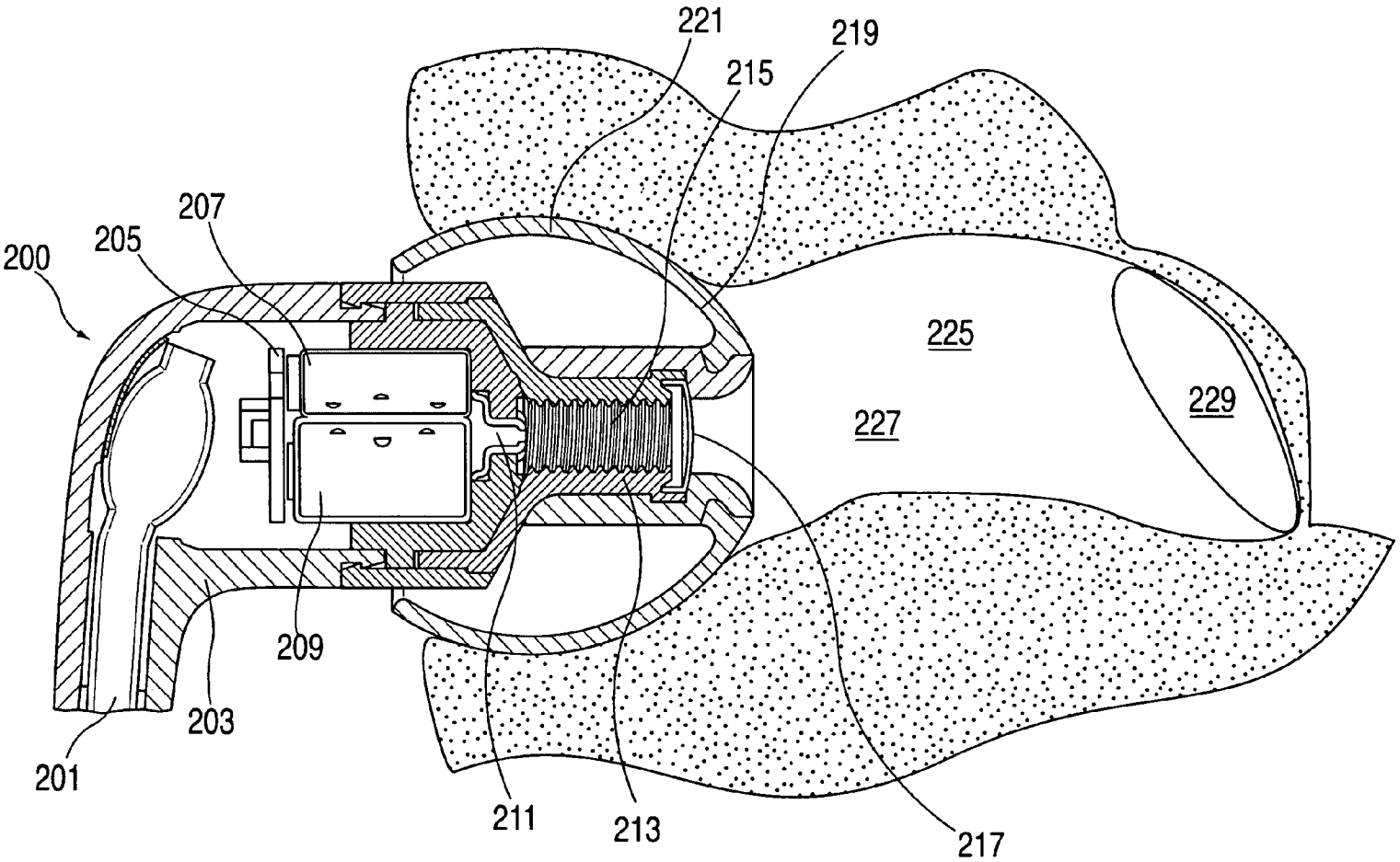
FIG. 2A is an illustration of an earbud inserted into an ear canal in accordance with an embodiment of the present invention.

FIG. 2A is an illustration of an in-the-ear earbud 200, inserted into an ear canal 225, which is constructed in accordance with an embodiment of the present invention. Earbud 200 includes wire bundle 201, circuit board 205, tweeter receiver 207, woofer receiver 209, outlet 211, port tube 213 housing acoustically resistive structures 215, dust cap 217, and bulb tip 219.

Electrical signals originating from an electronic device, such as device 109 of FIG. 1, can be conducted through wire bundle 201 to the body of earbud 200. Wire bundle 201 can include one or more wires. Each wire in wire bundle 201 can be used to conduct a different signal. For example, if earbud 200 has multiple receivers that are each dedicated to a particular frequency band, then each receiver may be driven by a separate wire on which audio information in that frequency band can be transmitted. Alternatively, one wire can be used to transmit audio information intended for multiple receivers. In this case, a crossover filter implemented on circuit board 205 may be used to separate the transmitted information by frequency band before directing the electrical signal to each receiver.

Figure 2B:
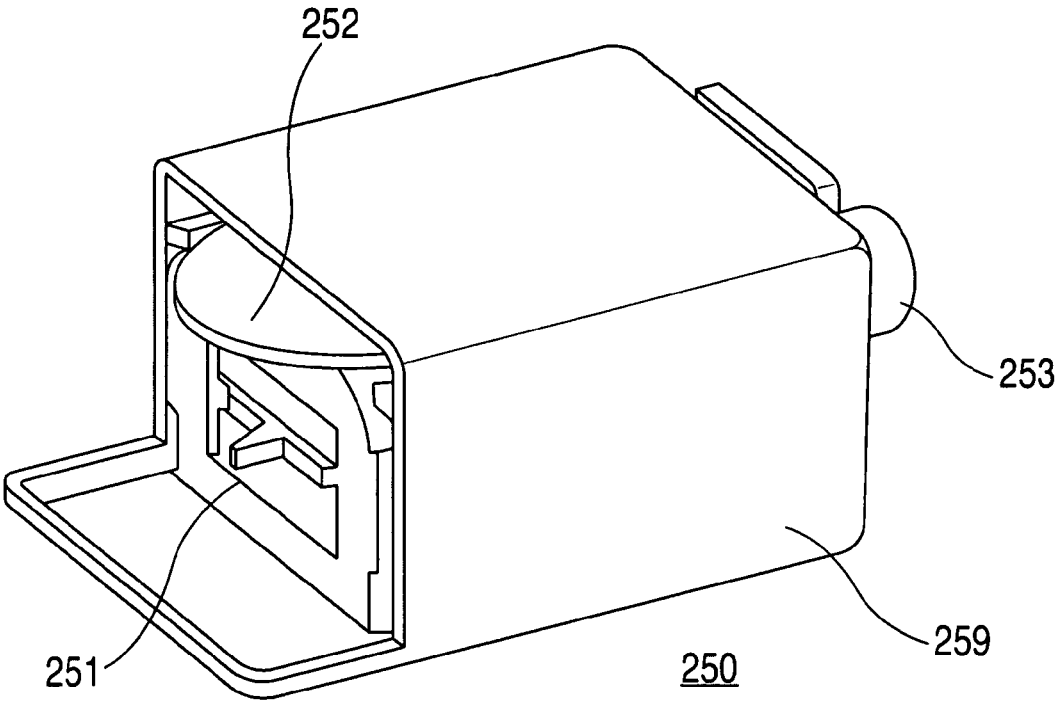
FIG. 2B is an illustration of an exemplary receiver in accordance with an embodiment of the present invention.

FIG. 2A shows two receivers, tweeter 207 and woofer 209. However, earbuds having more or less than two receivers would still fall within the scope of the present invention. Each receiver 207 and 209 houses a transducer (not shown in FIG. 2A) that is designed, in general, to produce optimal sound quality within a given frequency band. Woofers are generally designed to produce low frequency sound and tweeters are generally designed for high frequency sound. The interior of an exemplary receiver encasing a transducer is shown in FIG. 2B.

Receiver 250 generally includes an outer casing 259 containing an armature 251 that drives a diaphragm 252 back and forth. The movement of diaphragm 252 compresses and decompresses the air inside encasement 259, creating sound waves. The sound waves propagate out of receiver 250 through outlet 253. If receiver 250 corresponds to receiver 207 or 209 in FIG. 2A, then outlet 253 may correspond to outlet 211. Receiver 250 can have a variety of designs. For example, the shape of diaphragm 252 and the design of armature 251 are variable. Earbuds with a different receiver design than that shown in FIGS. 2A and 2B would still fall within the scope of the present invention.

Sound waves generated by receivers 207 and 209 are combined in outlet 211 and then introduced together into port tube 213. Port tube 213 can be designed to have a variety of shapes and sizes, and can contain acoustically resistive structures 215. Together, port tube 213 and resistive structures 215 function to improve the sound quality of earbud 200, as will be explained further below. A dust cap 217 may be located at the end of port tube 213. The primary purpose of dust cap 217 is to prevent dust, earwax, and other foreign objects from entering port tube 213. In addition, dust cap 217 can also act as an acoustically resistive structure, like resistive structures 215. The effect of dust cap 217 on sound quality is also explained further below.

Despite the presence of dust cap 217, foreign objects may still enter port tube 213. Thus, it may be beneficial in some embodiments to make port tube 213 removable. For example, port tube 213 may be kept in place in earbud 200 by screw threads. In this case, port tube 213 can be unscrewed out of earbud 200. After its removal, port tube 213 can then be serviced or cleaned. Port tube 213 can also be made to be disposable and replaceable.

Ear canal 225 is nominally approximately cylindrically shaped with a diameter of around 7 mm and length of around 25 mm, although this will vary from person to person. At the end of ear canal 225 is eardrum 229. Eardrum 229 is a thin membrane that separates ear canal 225 from the middle ear. Sound waves present in ear canal 225 are transferred to the rest of the auditory system through eardrum 229.

The section of earbud 200 that is inserted into ear canal 225 is enclosed in bulb tip 219. Bulb tip 219 can be composed of a flexible or moldable material, such as silicone or foam, that allows earbud 200 to fit snuggly and comfortably into ear canal 225. Bulb tip 219 can also form an air tight and sound isolating seal 221 against the sides of ear canal 225. Accordingly, receivers 207 and 209, eardrum 229, and the sides of ear canal 225 can form an enclosed cavity 227 that encompasses the volume in port tube 213 and ear canal 225. Sound waves produced by receivers 207 and 209 are contained within cavity 227 while sound waves from external sources are, for the most part, advantageously blocked out. Thus, sound isolating seal 221 and the resulting cavity 227 substantially eliminate acoustic corruption from external sources.

Like many systems that include volumes of air to operate (e.g., woodwind instruments, a partially-filled glass of water), cavity 227 can act like an acoustic resonator. Acoustic resonators, such as a Helmholtz resonator, selectively amplify sound waves with certain frequencies (e.g., the system's resonant frequencies). Resonance occurs in cavity 227 partly because sound waves introduced by receivers 207 and 209 into cavity 227 may reflect off the boundaries of cavity 227. Waves oscillating at resonant frequencies tend to reflect in such a way that the incident and reflected waves are in phase, and their amplitudes are additive when the waves are superimposed. Conversely, waves oscillating at some non-resonant frequencies tend to reflect so that the incident and reflected waves partially, or even completely, cancel. Thus, when receivers 207 and 209 generate an audio signal comprising a variety of frequencies (e.g., a piece of music), cavity 227 selectively amplifies some frequencies and dampens others, thereby distorting the original signal.

Although wave reflection can occur at any part of cavity 227's boundaries and in any direction, the main path of sound wave propagation and reflection is along the length of cavity 227. Therefore, cavity 227's resonant frequencies are determined largely by the distance between receivers 207 and 209 and eardrum 229. In particular, since an incident wave must be reflected back in phase in order for full amplification to occur, the round trip distance between receivers 207 and 209 and eardrum 229 is equal to an integer multiple of each of the corresponding wavelengths of the system's resonant frequencies. In other words, cavity 227 can have a lowest ("fundamental") resonant frequency who's corresponding wavelength is equal to cavity 227's round trip length, and a series of higher resonant frequencies ("overtones") that are integral multiples of the fundamental frequency.

It can be seen from the discussion above that the properties of cavity 227 play an important role in determining the sound quality of earbud 200. Since the properties of ear canal 225 are uncontrollable, the sound quality of earbud 200 can be improved by appropriately designing port tube 213. For example, changing the length of port tube 213 changes the overall distance between receivers 207 and 209 and eardrum 229, thereby changing the resonant frequencies of cavity 227. Port tube 213 can also have a variety of shapes. Many port tubes 213 are cylindrical, as is shown in FIG. 2A. Other port tubes 213 are ellipsoidal. Still other port tubes 213 have other shapes that have advantageous acoustic properties. In some embodiments, port tube 213 may include multiple discrete port tubes that are placed in parallel to each other. For example, there may be separate port tubes for receivers 207 and 209. The multiple discrete port tubes may collect into a common port tube, which then opens to ear canal 225.

Port tube 213 can also be composed of different materials with different acoustic properties. Some materials reflect sound well while others absorb some of the energy carried by the waves. In one embodiment, port tube 213 is made from aluminum. Aluminum is particularly suitable because it is durable and easy to manufacture into small and thin parts. In another embodiment, port tube 213 is composed of plastic.

Although most port tubes in existence are hollow, port tube 213 can advantageously contain acoustically resistive structures 215. Acoustically resistive structures 215 can be designed to decrease the effects of resonance in earbud 200. In one embodiment, resistive structures 215 are self-contained parts that are inserted into port tube 213. In another embodiment, resistive structures 215 comprise textured alterations made to the inner surface of port tube 213. For example, FIG. 2A shows a cylindrical port tube 213 with threads carved into its inner surface. In still another embodiment, the two previously described techniques can be combined. If port tube 213 includes multiple discrete port tubes arranged in parallel, as described above, each discrete port tube may contain distinct resistive structures. Furthermore, if the discrete port tubes collect into a common port tube, the common port tube may contain additional resistive structures. These embodiments and exemplary port tube 213 designs are described in more detail in connection with FIGS. 3-5 below.

Figure 3A:
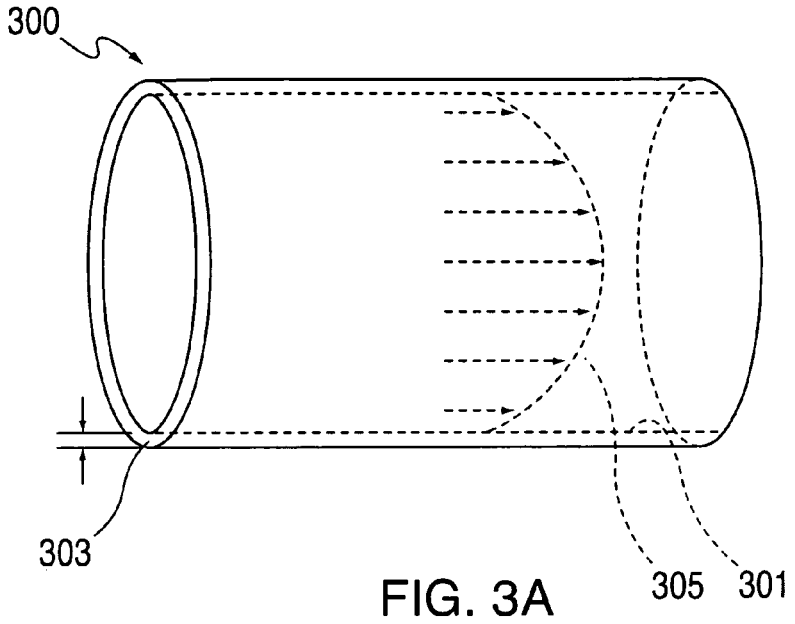
FIG. 3A is an illustration of an earbud port tube.

FIG. 3A is a more detailed illustration of a port tube 300 that does not contain acoustically resistive structures. Port tube 300 is commonly used in currently existing earbuds and has disadvantageous acoustic properties. Like port tube 213 of FIG. 2A, port tube 300 is cylindrical. However, one skilled in the art will appreciate that the present discussion regarding resonance and port tube design is applicable to port tubes of other shapes as well. The left end of port tube 300 is connected either directly or through an intermediate device to one or more receivers. Thus, sound waves are introduced into port tube 300 from the left opening. The right end of port tube 300 opens to the ear canal, as shown for port tube 213 in FIG. 2A. There may or may not be a dust cap, such as dust cap 217 of FIG. 2A, at the right end of port tube 300. In an exemplary embodiment, port tube 300 can be composed of aluminum. The thickness 303 of port tube 300 is preferably very thin, since the entire earbud is small. The inner surface 301 of port tube 300 is smooth and the interior of port tube 300 is hollow. Because there are no objects providing acoustic resistance in port tube 300, sound waves tend to propagate through port tube 300 smoothly and uninterrupted. In particular, the flow profile 305 of air in port tube 300 can be substantially laminar. Because there are no resistive structures in port tube 300 (and the ear canal) to diffuse or absorb the acoustic energy, sound waves oscillating at resonant frequencies are maximally amplified.

Figure 3B:
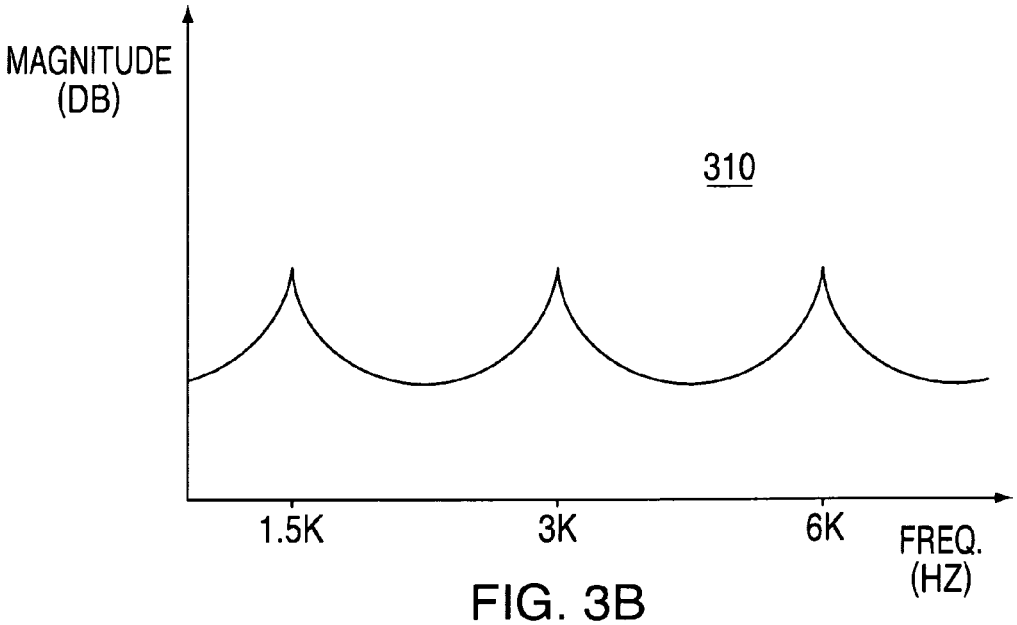
FIG. 3B is an illustration of an exemplary frequency response of the cavity formed by an ear canal and the port tube shown in FIG. 3A.

Accordingly, a cavity including port tube 300, such as cavity 227 of FIG. 2A, will likely experience significant resonance effects. The effect of port tube 300 on sound quality can be better understood by considering the frequency response of the cavity formed by port tube 300 and an ear canal (e.g., ear canal 225). An exemplary frequency response is shown in FIG. 3B. The abscissa of graph 310 plots the frequency in Hertz. The ordinate of graph 310 plots the magnitude, which may be shown in decibels (dB). For exemplary purposes, graph 310 shows that the frequency response of the cavity peaks at 1.5 kHz, 3 kHz, and 6 kHz. These are the first three resonant frequencies (the fundamental frequency and two overtones, respectively) of the cavity. At these three frequencies, the cavity provides high gain to the sound waves. In contrast, sound waves at non-resonant frequencies are attenuated by the cavity. Thus, the cavity selectively amplifies some sound waves while attenuating others, thereby distorting the sound waves propagating through it, as illustrated in FIG. 3B. Such distortion can result in a degraded user experience.

Figure 4A:
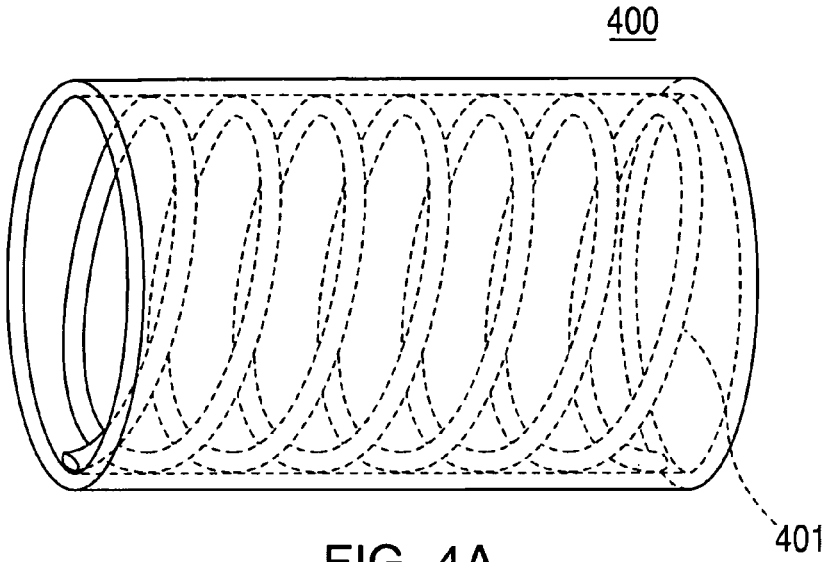
FIG. 4A is an illustration of an earbud port tube incorporating an acoustically resistive spring coil in accordance with one embodiment of the present invention.

The peaks in the frequency response of a port tube/ear canal cavity can be advantageously flattened by, for example, inserting acoustically resistive structures into the port tube in accordance with embodiments of the invention. FIG. 4A shows a port tube 400 with a spring coil 401 inserted into its interior. Spring coil 401 can be utilized to disrupt the laminar flow of air through port tube 400, causing sound diffusion and reducing the magnitude of sound amplification caused by resonance in accordance with the principles of one embodiment of the present invention. Spring coil 401 can also absorb acoustic energy. Depending on its tension, length, shape, and other properties (such as material), spring coil 401 may be designed to preferentially absorb sound waves within a certain frequency band. By adjusting these parameters, the frequency response of the ear canal/port tube 400 cavity can be finely controlled which can result in a higher quality audio output signal.

Figure 4B:
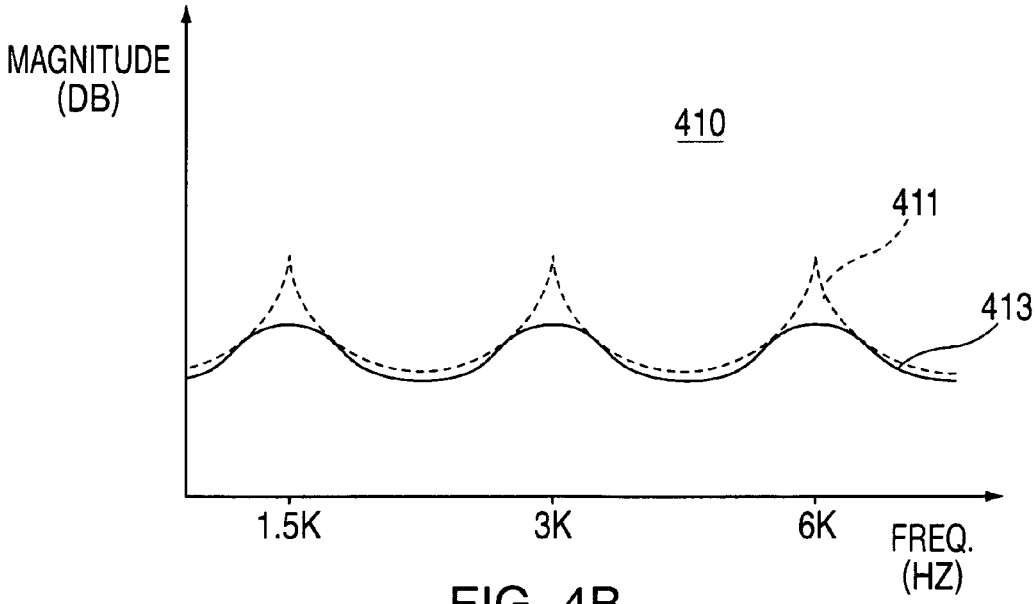
FIG. 4B is an illustration of an exemplary frequency response of the cavity formed by an ear canal and the port tube system shown in FIG. 4A.

For example, one advantageously flattened frequency response 413 of a cavity which includes port tube 400 is shown in FIG. 4B, along with frequency response 411 which represents the frequency response of port tube 300 of FIG. 3A. Graph 413 shows that the amplification provided by port tube 400 at the resonant frequencies is substantially less than that provided by port tube 300. Furthermore, although frequency response 413 is attenuated at its resonant frequencies, it is not significantly attenuated at its non-resonant frequencies. This feature of port tube 400 is particularly notable because it indicates that port tube 400 prevents energy loss at frequencies where attenuation is not necessary. A less intricate resistive structure, such as a mesh filter erected in the cross-section of port tube 400, would potentially cause energy loss across all frequencies.

In some applications of port tube 400, it may be beneficial to provide a large amount of attenuation at resonant frequencies and a small amount of attenuation across all frequencies. In this case, port tube 400 may include spring coil 401 to flatten the resonant peaks and a simple mesh filter to provide damping across all frequencies. An example of a mesh filter is dust cap 217 of FIG. 2A. More than one mesh filter can be incorporated into port tube 400. There may be, for example, a second mesh filter between the left end of port tube 400 and outlet 211 of FIG. 2A.

As mentioned previously, frequency response 413 associated with port tube 400 can be finely tuned by appropriately determining the parameters of spring coil 401. For example, the spring tension, spring length, number of coils, cross-sectional shape of spring coil 401, and cross-sectional shape of the coil wire are all parameters that can be adjusted during the manufacturing of the host earbud to "tune" the port tube to the desired resonant frequencies and optimal peaking magnitude. The cross-sectional shape of spring coil 401 may, for example, be rectangular or elliptical instead of circular. The tension of spring coil 401 can control frequency-dependent sound absorption. The length of spring coil 401 need not be the same length as port tube 400. Spring coil 401 can also have a diameter that is substantially smaller than the diameter of port tube 401. In this case, spring coil 401 can be secured in place by support fixtures connected to the interior surface of port tube 400.

Figure 5A:
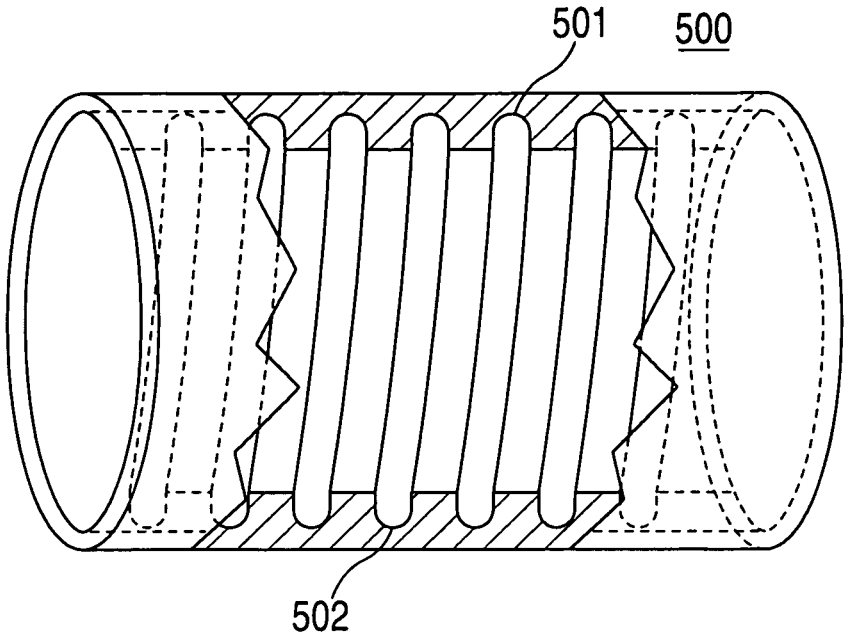
FIG. 5A is an illustration of an earbud port tube with a textured inner surface in accordance with one embodiment of the present invention.

The insertion of a spring into a port tube is not the only way to achieve the advantageous air flow disruptions, and subsequent reduction in resonance effects, described above. The same effects can be obtained, in accordance with one embodiment of the present invention, by altering the interior walls of the port tube. In FIG. 5A, there is shown a port tube 500 whose interior walls are not smooth, unlike port tube 300 of FIG. 3A. Instead, screw threads 501 can be etched into the wall of port tube 500. In one embodiment, screw threads 501 spiral down the length of port tube 500. In another embodiment, screw threads 501 form multiple closed circles along the length of port tube 500. In other embodiments, screw threads 501 can form any appropriate pattern on the interior wall of port tube 500.

Figure 5B:
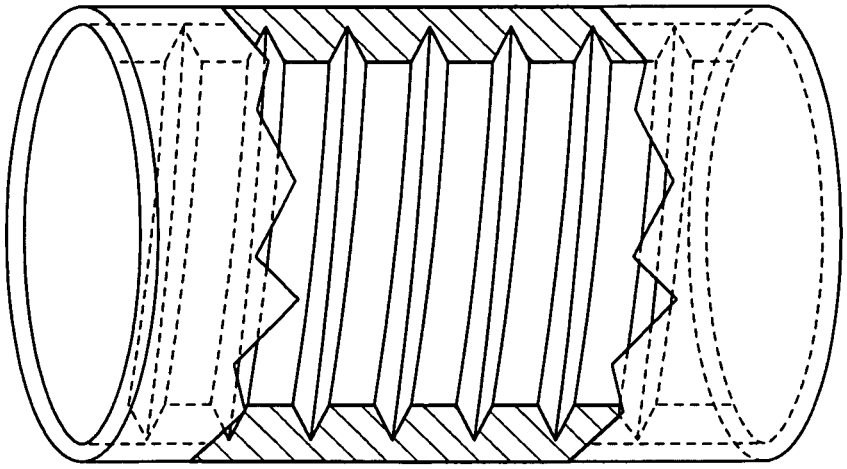
FIG. 5B is an illustration of an earbud port tube with another textured inner surface in accordance with one embodiment of the present invention.

Like spring coil 401 of FIG. 4A, screw threads 501 function to disrupt uniform laminar air flow along port tube 500, which can lead to strong resonance effects and a frequency response having many peaks, as described above. Screw threads 501 act to create texture on the inner surface of port tube 500 that can advantageously cause sound diffusion. The groove shape 502 of threads 501 can take many forms. In one embodiment, groove shape 502 is semicircular, as shown in FIG. 5A. In another embodiment, the groove shape can be triangular or jagged, as shown in FIG. 5B. The extent of air flow disruption and sound diffusion caused by screw threads 501 can be dependent on groove shape 502 and the depth of screw threads 501.

One advantage of the design of port tube 500 is that additional components (e.g., spring coils) are not needed. Not only does this reduce the manufacturing complexity and parts cost of port tube 500, it decreases the probability of device failure, which generally increases with the number of additional and/or movable parts in a device. Additionally, like port tube 400 of FIG. 4A, port tube 500 provides several parameters, such as groove shape 502 and the pattern of screw threads 501, that can be adjusted to tune port tube 500 to a desired frequency response. For example, achieving a particular frequency response may require screw threads of a certain shape, depth, and pattern over a portion of the inner surface of port tube 500.

Figure 6:
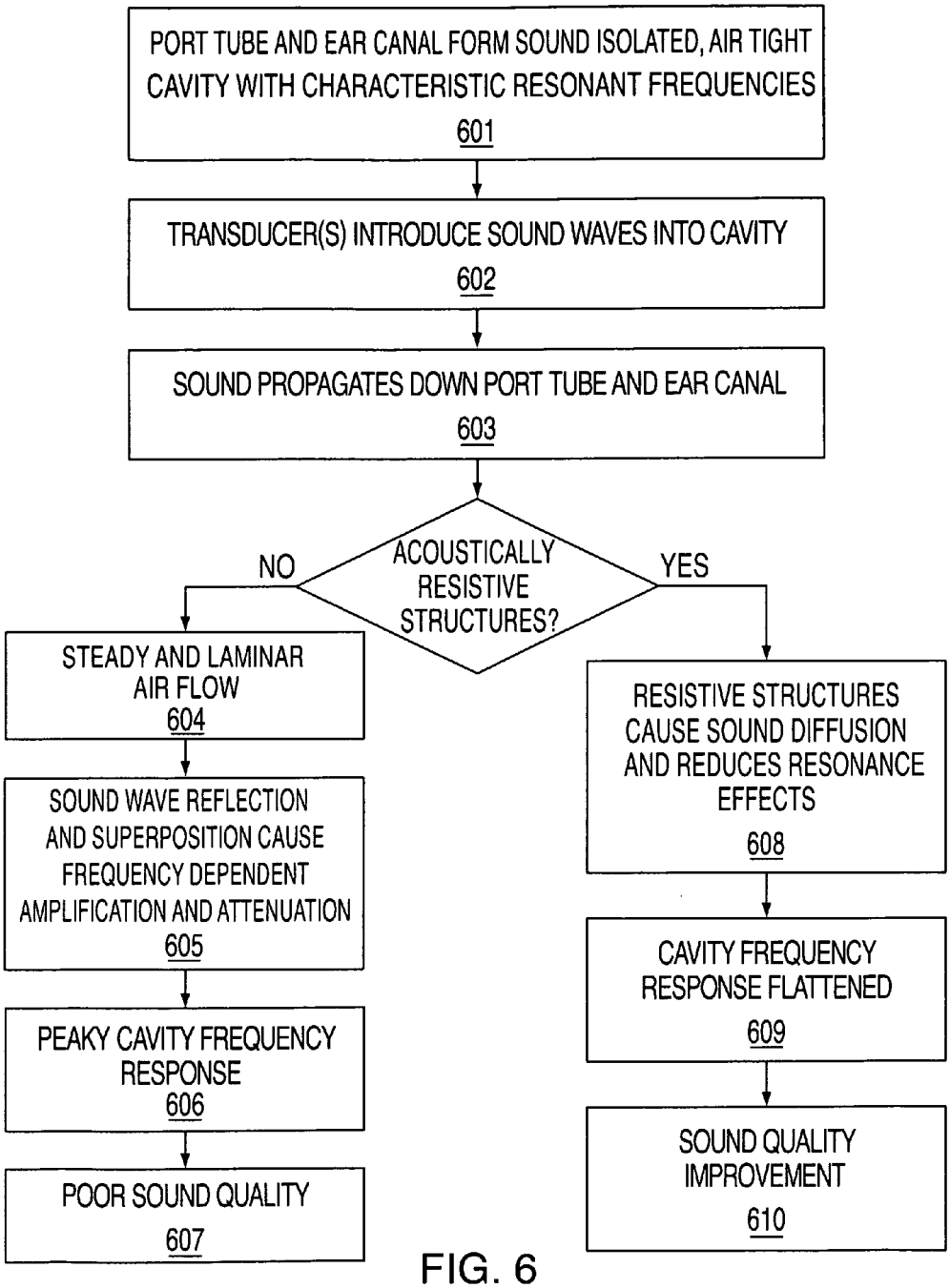
FIG. 6 is a flow chart detailing the effects of resonance on earbud sound quality.

Continuing on to FIG. 6, there is shown a flow diagram detailing the functionality of an in-the-ear earbud port tube. Port tubes direct sound from the receivers of an earbud to the eardrum. In an in-the-ear earbud, the port tube is generally surrounded by a moldable bulb that forms a substantially air tight seal against the ear canal. The result of this seal is a sound isolating cavity that advantageously blocks out external noise (step 601). However, this cavity, which includes the volume in the port tube and the volume in the ear canal, can have characteristic resonant frequencies. Sound waves oscillating at resonant frequencies tend to be amplified by the cavity. The cavity's resonant frequencies are largely determined by the length of the cavity, and consist of a fundamental frequency and its overtones.

Located at one end of the cavity are one or more transducers. The transducers may be part of a receiver unit and there may be an intermediate piece of hardware located between the transducers and the cavity, such as outlet 211 of FIG. 2A. Located at the other end of the cavity is the eardrum. At step 602, sound waves are introduced into the cavity by one or more of the transducers. Sound waves are generated by volumes of air that oscillate in the longitudinal direction (along the length of the cavity). From the transducers, the sound waves propagate down the port tube and ear canal towards the eardrum (step 603).

If the port tube does not contain any acoustically resistive structures, the air flow in the cavity can be steady and laminar (step 604). This can lead to particularly strong resonance effects due to wave reflection and superposition. The resonance effects can be frequency-dependent amplification and attenuation of sound (step 605). A quantitative way to characterize this phenomenon is to plot the cavity's frequency response, which in this case has peaks at the resonant modes, such as that shown in FIG. 3B (step 606). Because the cavity does not provide uniform gain, the eardrum tends to perceive a distorted version of the sound produced by the transducers. Thus, a cavity lacking acoustically resistive structures can lead to poor sound quality (step 607).

Alternatively, fitting a cavity with acoustically resistive structures would disrupt the steady and laminar flow of air, leading to sound diffusion and a reduction in resonance effects (step 608). Two methods described above in accordance with embodiments of the present invention to add acoustic resistance to a hollow port tube include inserting a spring coil into the tube and/or carving screw threads into the inner surface of the tube. In those methods, the resistive structures can undergo minor alterations, allowing for fine tuning of the frequency response of the cavity. The general effect of resistive structures is to flatten the frequency response to approach uniform gain (step 609). Thus, the port tube designs described herein improve sound quality in in-the-ear earbuds (step 610).

Thus it is seen that systems, apparatus and methods for producing higher quality audio output signals using in-the-ear headphones are provided. Embodiments of the present invention produce improved audio output signals by disrupting the flow of the generated sound waves in order to reduce the effects such as laminar flow that result from smooth, unobstructed surfaces in traditional in-the-ear headphone devices. It will be understood that the foregoing is only illustrative of the principles of the invention, and that various modifications can be made by those skilled in the art without departing from the scope and spirit of the invention, and the present invention is limited only by the claims that follow.

What is claimed is:

1. An in-ear-canal headphone comprising:

at least one transducer;

an air chamber comprising a first opening and a second opening, wherein the first opening is configured to allow air flow between the air chamber and the at least one transducer, and wherein the second opening is configured to allow air flow between the air chamber and a wearer's ear canal; and an acoustically resistive structure comprising a plurality of grooves formed along an inner surface of the air chamber, wherein the plurality of grooves is configured to control resonance in the air chamber and in the wearer's ear canal by extending along the inner surface from the first opening of the air chamber to the second opening of the air chamber.

2. The headphone of claim 1, wherein the acoustically resistive structure causes sound diffusion in the air chamber.

3. The headphone of claim 1, wherein the second opening of the air chamber is configured to couple to walls of the wearer's ear canal by a substantially air tight seal.

4. The headphone of claim 3, wherein the air tight seal is constructed from silicone.

5. The headphone of claim 3, wherein the seal is constructed from foam.

6. The headphone of claim 3, wherein the air chamber and the wearer's ear canal form a sound isolating cavity.

7. The headphone of claim 6, wherein the acoustically resistive structure acts to flatten out a frequency response of the sound isolating cavity.

8. The headphone of claim 1, wherein the plurality of grooves comprises:

a pattern of grooves carved into the inner surface of the air chamber.

9. The headphone of claim 1, wherein the plurality of grooves comprises:

a spiral screw thread formed along the inner surface of the air chamber.

10. The headphone of claim 1, wherein at least one groove of the plurality of grooves comprises an indentation shape, and wherein the indentation shape is semi-circular.

11. The headphone of claim 1, wherein at least one groove of the plurality of grooves comprises an indentation shape, and wherein the indentation shape is triangular.

12. The headphone of claim 1, wherein at least one groove of the plurality of grooves comprises an indentation shape, and wherein the indentation shape is trapezoidal.

13. The headphone of claim 1, wherein the at least one transducer comprises at least one of:

a woofer and a tweeter.

14. The headphone of claim 1, wherein the air chamber is cylindrical in shape.

15. The headphone of claim 1, wherein the air chamber is constructed from aluminum.

16. The headphone of claim 1, wherein the air chamber is removable from the headphone.

17. The headphone of claim 1, wherein the air chamber further comprises:

at least one porous filter across the cross-section of the air chamber.

18. The in-ear-canal headphone of claim 1, wherein a depth of at least one groove of the plurality of grooves is configured to control the resonance.

19. The in-ear-canal headphone of claim 1, wherein the plurality of grooves comprises a plurality of closed circles along the inner surface of the air chamber.

20. The in-ear-canal headphone of claim 1, wherein:

the first opening is positioned at a first end of the air chamber;

the second opening is positioned at a second end of the air chamber; and the plurality of grooves is configured to control resonance in the air chamber and in the wearer's ear canal by extending from the first end of the air chamber to the second end of the air chamber.

21. A method for controlling resonance in an in-ear-canal headphone, the method comprising:

generating sound waves by utilizing at least one transducer;

directing the generated sound waves from the at least one transducer to a wearer's ear canal through an air chamber having a first opening and a second opening, wherein the first opening is configured to allow air flow between the air chamber and the at least one transducer, and the second opening is configured to allow air flow between the air chamber and the wearer's ear canal;

diffusing the generated sound waves by utilizing an acoustically resistive structure comprising a plurality of grooves formed along an inner surface of the air chamber, wherein the plurality of grooves is configured to control resonance in the air chamber and in the wearer's ear canal by extending along the inner surface from the first opening of the air chamber to the second opening of the air chamber; and controlling resonance of the generated sound waves in the air chamber and in the wearer's ear canal based on the configuration of the plurality of grooves.

22. The method of claim 21, wherein the second opening of the air chamber is configured to couple to walls of the wearer's ear canal by a substantially air tight seal.

23. The method of claim 22, wherein the air chamber and the wearer's ear canal form a sound isolating cavity.

24. The method of claim 23, wherein the controlling the resonance comprises:

flattening a frequency response of the sound isolating cavity.

25. The method of claim 21, wherein the generating the sound waves comprises:

generating low frequency sound waves using a woofer; and generating high frequency sound waves using a tweeter.

26. The method of claim 21, wherein:

the first opening is positioned at a first end of the air chamber;

the second opening is positioned at a second end of the air chamber; and the plurality of grooves is configured to control resonance in the air chamber and in the wearer's ear canal by extending from the first end of the air chamber to the second end of the air chamber.

27. An in-ear-canal headphone for use with a portable media device, the in-ear-canal headphone comprising:

at least one transducer;

an air chamber comprising a first opening and a second opening, wherein the first opening is configured to allow air flow between the air chamber and the at least one transducer, and wherein the second opening is configured to allow air flow between the air chamber and a wearer's ear canal; and an acoustically resistive structure comprising a spring coil disposed along an inner surface of the air chamber, wherein the spring coil is configured to control resonance in the air chamber and in the wearer's ear canal by extending along the inner surface from the first opening of the air chamber to the second opening of the air chamber.

28. The in-ear-canal headphone of claim 27, wherein the spring coil is secured to the air chamber via at least one support portion connected to the inner surface of the air chamber.

29. The in-ear-canal headphone of claim 27, wherein the air chamber and the wearer's ear canal form a sound isolating cavity.

30. The in-ear-canal headphone of claim 29, wherein the acoustically resistive structure acts to flatten out a frequency response of the sound isolating cavity.

31. The in-ear-canal headphone of claim 30, wherein the spring coil is configured with a number of turns to control the frequency response of the sound isolating cavity.

32. The in-ear-canal headphone of claim 30, wherein the spring coil comprises a cross-sectional shape that is configured to control the frequency response of the sound isolating cavity.

33. The in-ear-canal headphone of claim 32, wherein the cross-sectional shape is circular.

34. The in-ear-canal headphone of claim 32, wherein the cross-sectional shape is rectangular.

35. The in-ear-canal headphone of claim 27, wherein the spring coil is further configured to control the resonance based on at least one of a tension, a length, a shape, and a type of material of the spring coil.

36. The in-ear-canal headphone of claim 27, wherein:

the first opening is positioned at a first end of the air chamber;

the second opening is positioned at a second end of the air chamber; and the spring coil is configured to control resonance in the air chamber and in the wearer's ear canal by extending from the first end of the air chamber to the second end of the air chamber.

37. A headphone device comprising:

a first transducer;

a second transducer;

a first air chamber in acoustic communication with the first transducer;

a second air chamber in acoustic communication with the second transducer; and a third air chamber in acoustic communication with each of the first air chamber and the second air chamber, wherein one air chamber of the first air chamber, the second air chamber, and the third air chamber comprises an acoustic resistive portion, wherein the acoustic resistive portion comprises at least one of:

a plurality of grooves formed along an inner surface of the one air chamber, wherein the plurality of grooves is configured to control resonance of sound emitted by at least one of the first transducer and the second transducer by extending from one end of the one air chamber to another end of the one air chamber; and a spring coil disposed along the inner surface of the one air chamber, wherein the spring coil is configured to control the resonance by extending from the one end of the one air chamber to the another end of the one air chamber.

38. The headphone device of claim 37, wherein the acoustic resistive portion comprises a combination of the plurality of grooves and the spring coil.

39. The headphone device of claim 37, wherein the one air chamber is configured to form a sound isolating cavity with a user's ear canal.

40. The headphone device of claim 39, wherein the acoustic resistive portion is configured to flatten out a frequency response of the sound isolating cavity.

41. The headphone device of claim 38, wherein the one air chamber is the third air chamber, and wherein the first air chamber comprises another acoustic resistive portion.

42. The headphone device of claim 37, wherein the one air chamber is the third air chamber, and wherein the second air chamber comprises another acoustic resistive portion.

* * * * *